US010968580B2

(12) United States Patent
Klein

(10) Patent No.: US 10,968,580 B2
(45) Date of Patent: Apr. 6, 2021

(54) PROTECTIVE STRUCTURE

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 0 days.

(21) Appl. No.: 16/463,968

(22) PCT Filed: Nov. 27, 2017

(86) PCT No.: PCT/IL2017/051288

§ 371 (c)(1),
(2) Date: May 24, 2019

(87) PCT Pub. No.: WO2018/096543

PCT Pub. Date: May 31, 2018

(65) Prior Publication Data

US 2020/0283972 A1 Sep. 10, 2020

(30) Foreign Application Priority Data

Nov. 27, 2016 (IL) ..... 249244

(51) Int. Cl.
*E01F 7/04* (2006.01)
*E04C 5/18* (2006.01)
*E04H 9/06* (2006.01)

(52) U.S. Cl.
CPC ..... *E01F 7/045* (2013.01); *E04C 5/18* (2013.01); *E04H 9/06* (2013.01)

(58) Field of Classification Search
CPC .... E01F 7/00; E01F 7/04; E01F 7/045; E04C 5/18; E04B 9/00; E04B 1/161; E04B 5/21; E04H 9/06; E04H 9/00; E04H 9/04
See application file for complete search history.

(56) References Cited

U.S. PATENT DOCUMENTS

| | | | | | |
|---|---|---|---|---|---|
| 4,003,208 | A * | 1/1977 | Hornung | E21D 23/0004 | 405/288 |
| 5,012,622 | A * | 5/1991 | Sato | E02D 5/30 | 52/263 |
| 5,096,335 | A * | 3/1992 | Anderson | E21D 11/152 | 405/150.1 |
| 2007/0131917 | A1* | 6/2007 | Wartmann | E01F 7/045 | 256/12.5 |
| 2012/0205496 | A1* | 8/2012 | Ferraiolo | B21F 27/06 | 245/2 |

FOREIGN PATENT DOCUMENTS

| | | | | |
|---|---|---|---|---|
| CN | 201981681 | U | 9/2011 | |
| CN | 205857487 | U | 1/2017 | |
| EP | 0018619 | A1 * | 11/1980 | G08B 21/10 |
| EP | 2166175 | A1 | 3/2010 | |
| JP | H0874215 | A | 3/1996 | |
| JP | H0874215 | A * | 3/2010 | E01F 7/04 |
| JP | 2017071922 | A | 4/2017 | |
| WO | 2010132900 | A1 | 11/2010 | |

* cited by examiner

*Primary Examiner* — Jessie T Fonseca
(74) *Attorney, Agent, or Firm* — William Dippert; Laurence Greenberg; Werner Stemer

(57) ABSTRACT

A protective structure is provided that is configured to crush descending items into particles. The protective structure comprises an upper mesh layer made of hard material capable of crushing the descending items and a bottom layer made of combined hard material and relatively soft material, wherein the bottom layer is capable of absorbing the particles. The protective structure is further provided with a plurality of supporting poles that are positioned between the upper mesh layer and the bottom layer.

18 Claims, 5 Drawing Sheets

PROTECTIVE STRUCTURE

CROSS-REFERENCE TO RELATED APPLICATIONS

The present application is a National Phase filing under 35 U.S.C. § 371 of International Patent Application No. PCT/IL2017/051288, filed Nov. 27, 2017, which is based upon and claims the benefit of the priority date of Israeli Patent Application No. 249244, filed Nov. 27, 2016, each of which is expressly incorporated herein by reference in its entirety.

FIELD OF THE SUBJECT MATTER

The present subject matter relates to protective structures. More particularly, the present subject matter relates to structures that protect bounded space against falling and descending heavy items or ballistic arsenals.

BACKGROUND OF THE SUBJECT MATTER

Falling and descending objects instigated by circumstances such as projectile objects or arsenals, earthquake or volcano burst, meteorites, or building collapse can cause a sever damage to buildings, roads, train or bus stations, tunnel entrance, strategic areas, etc. Shields are provided on top or near those strategic places that are susceptible to such danger, however, in cases the descending object is relatively heavy, hot, or propelled, the available shields will not be sufficient in order to stop the fall or protect the items or people that are staying in the structure.

SUMMARY

It is therefore an object of the present subject matter to provide a protecting structure that can endure objects that are descending or falling on top of the structure. Further objects and advantages of this subject matter will appear as the description proceeds.

It is therefore provided in accordance with a preferred embodiment, a protective structure configured to crush descending items into particles, the protective structure comprising:

an upper mesh layer made of hard material capable of crushing the descending items;

a bottom layer made of combined hard material and relatively soft material, wherein the bottom layer is capable of absorbing the particles.

Furthermore, in accordance with another preferred embodiment, said hard material is metal.

Furthermore, in accordance with another preferred embodiment, said relatively soft material is concrete.

Furthermore, in accordance with another preferred embodiment, said hard material is embedded within said relatively soft material.

Furthermore, in accordance with another preferred embodiment, said relatively soft material is selected from a group of materials such as sand or aggregates.

Furthermore, in accordance with another preferred embodiment, the supporting structure is further provided with a plurality of supporting poles that are positioned between said upper mesh layer and said bottom layer.

Furthermore, in accordance with another preferred embodiment, the supporting poles are made of tubes of hard metal filled with concrete.

Furthermore, in accordance with another preferred embodiment, the supporting poles are made of concrete.

Furthermore, in accordance with another preferred embodiment, the concrete is reinforced.

Furthermore, in accordance with another preferred embodiment, the upper mesh layer is made of a plurality of mesh layers that are in an offset one relative to the other.

Furthermore, in accordance with another preferred embodiment, the mesh is made of cubicles of substantially 75×75 mm.

Furthermore, in accordance with another preferred embodiment, the upper mesh layer is not horizontal and is directed in a predetermined angle.

Furthermore, in accordance with another preferred embodiment, the bottom layer comprises a mesh layer.

Furthermore, in accordance with another preferred embodiment, the mesh layer is mounted on top of a barrel layer.

Furthermore, in accordance with another preferred embodiment, the mesh layer is supported on top of the barrel layer by supporting shafts.

Furthermore, in accordance with another preferred embodiment, the mesh layer is further supported by beams connected between the supporting shafts.

Furthermore, in accordance with another preferred embodiment, the bottom layer is made of a plurality of segments that are connected using connecting sheets that are provided on both edge sides of each segment.

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF THE PREFERRED EMBODIMENTS

Figure 1:
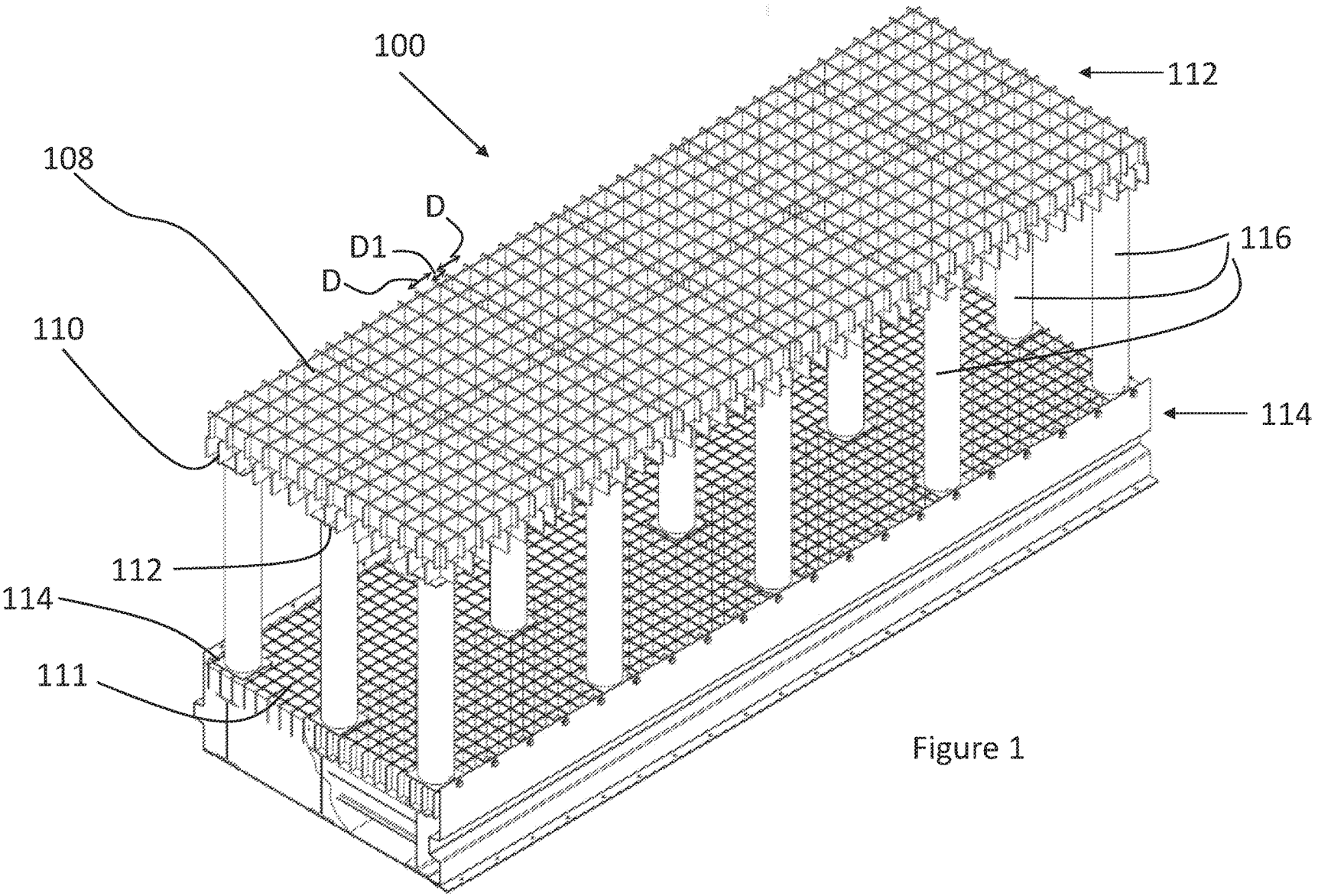
FIG. 1 illustrates a protecting structure in accordance with an exemplary embodiment of the subject matter.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

Reference is now made to FIG. 1 illustrating a protecting structure in accordance with an exemplary embodiment of the subject matter. The protecting structure 100 comprises two layers: an upper layer 102, a bottom layer 104 while between the two layers, supporting poles 106 are provided. The upper layer 102 is a crushing layer configured to crush any element that is clashes into the layer from above into small pieces or particles. In order to function in such a way, the structure of the upper layer 102 is a cubicle mesh of metal 108 that is upwardly and vertically directed. Alternatively and preferably, mesh 108 is provided with another mesh layer 110 underneath so as to establish two layers of mesh 108 and 110. The two layers are moved in a certain phase from one another (horizontally moved) so as to form an offset between the two layers, as will be clearly shown herein after. It should be mentioned that the crushing layer 102 can be made from one mesh or several meshes in different orientations or distance from one another. The layers can also be placed on one another or welded.

The mesh is made of hard metal of low thickness that renders the structure the capability to crash the descending object that hits the mesh. The vertical mesh cuts the descending object and slices it to pieces. Many of the pieces that are crashed are passing through the entire mesh.

It should be mentioned that the distance between the rows of the mesh from both directions can be different as can be seen in FIG. 1. A relatively smaller distance indicated by a double headed arrow D1 between the rows of the mesh is provided in a periodic manner among the regular distance of the mesh indicated by a double headed arrow D. It should be mentioned that the thickness of the mesh can be varied according to need and demands.

In order to improve the efficiency of the mesh, it can be provided with crushing elements such as arrows, bars, pins, or other elements that will make the crushing effect more effective and will also reduce the velocity of the descending object or it's parts.

Bottom layer 104 comprises also a mesh structure 111 supported on another structure as will be shown herein after.

Figure 2:
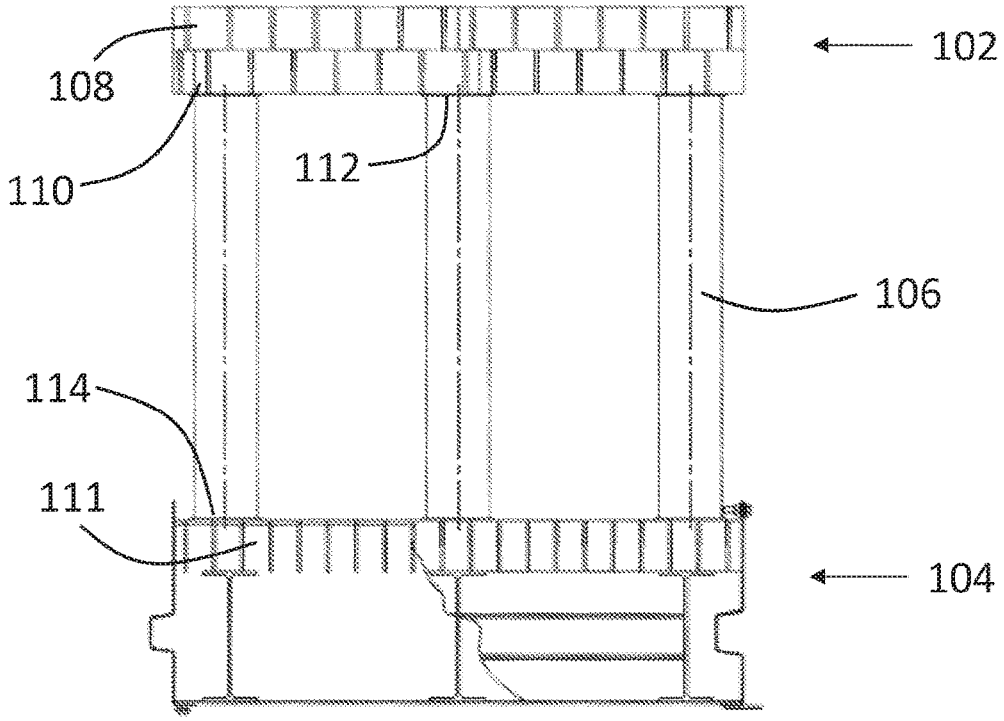
FIG. 2 illustrates side view of the structure shown in FIG. 1.
Figure 3:
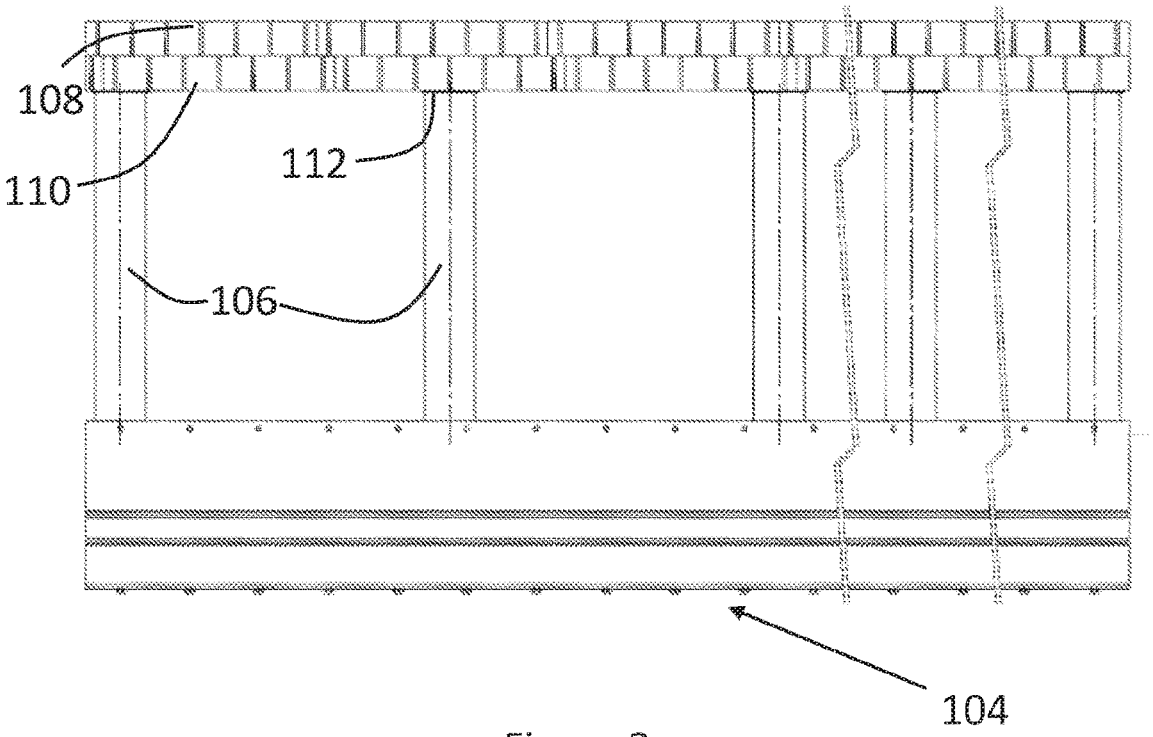
FIG. 3 illustrates a side view from another direction of the structure shown in FIG. 1.

Reference is now made to FIGS. 2 and 3 illustrating side views of the protecting structure. The upper layer 102 is mounted on supporting poles 106 that are organized in a manner by which the upper layer will be firmly held. The supporting poles 106 are preferably rounded and symmetric in their profile, however, they can be of any other profile without limiting the scope of the disclosed subject matter. The supporting poles 106, since they are bounded by mesh structure on both sides, are provided with a flat sheet metal 112 (shown also in FIG. 1) at their upper end wherein the flat sheet metal is providing support to the mesh that is mounted on the poles. On the other side, the bottom side of the poles 106, there is another sheet metal 114 that provides an additional support of the poles that are positioned on the bottom layer 102.

The poles 106 can be hollow tubes that are preferably filled with concrete or any other material that will provide additional strength. The concrete can be reinforced. The tubes themselves can be made of a hard metal or reinforced concrete. The choice of material is made by the needed strength of the structure and the expected hazard.

Figure 4:
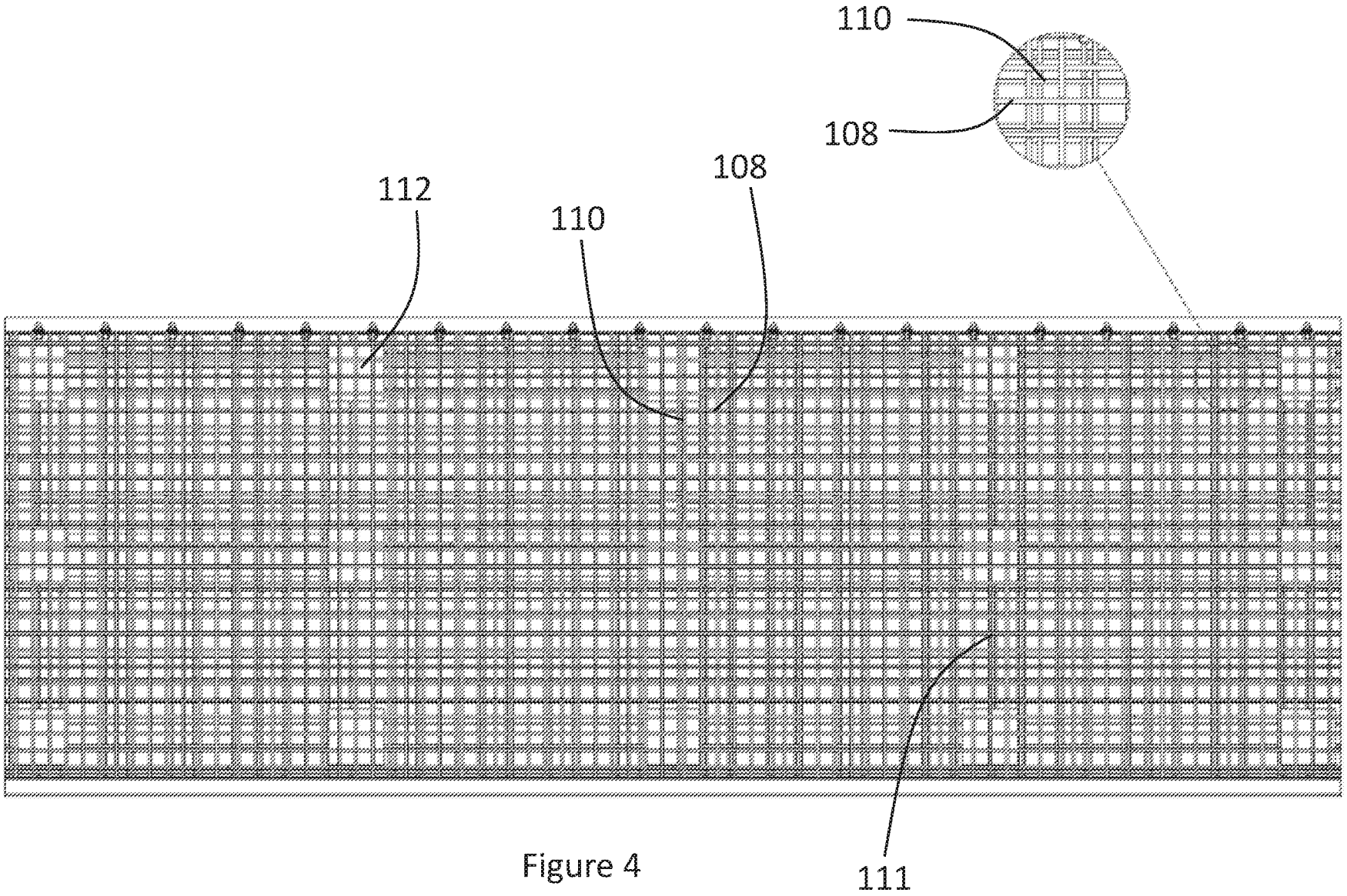
FIG. 4 illustrates an upper side view of the structure shown in FIG. 1.

Reference is now made to FIG. 4 illustrating an upper side view of the structure shown in FIG. 1, also in an enlarged view. Both mesh 108 and 108 that are offset from one another can be clearly seen in the main embodiment and the enlargement. In the main figure, the metal sheets 112 that are placed between the mesh and a pole (cannot be seen in FIG. 4) can be seen, while in the areas where the metal sheet is absent, the mesh 111 of the bottom layer 104 can be observed between the offset meshes 108 and 110. One can see that other than the sheets of metal that are provided on top and beneath the poles, there are no plates or sheets of metal. Alternatively, a sheet of metal or a flexible material can be provided below the upper layer 102 in order to keep possible parts of the crashed object from getting to the bottom layer.

It should be mentioned that in a preferred embodiment, the size of the mesh can be 75×75 mm so that the over whole mesh size is very smaller and will eventually prevent objects from damaging objects on mounted on the bottom layer 104.

Figure 5A:
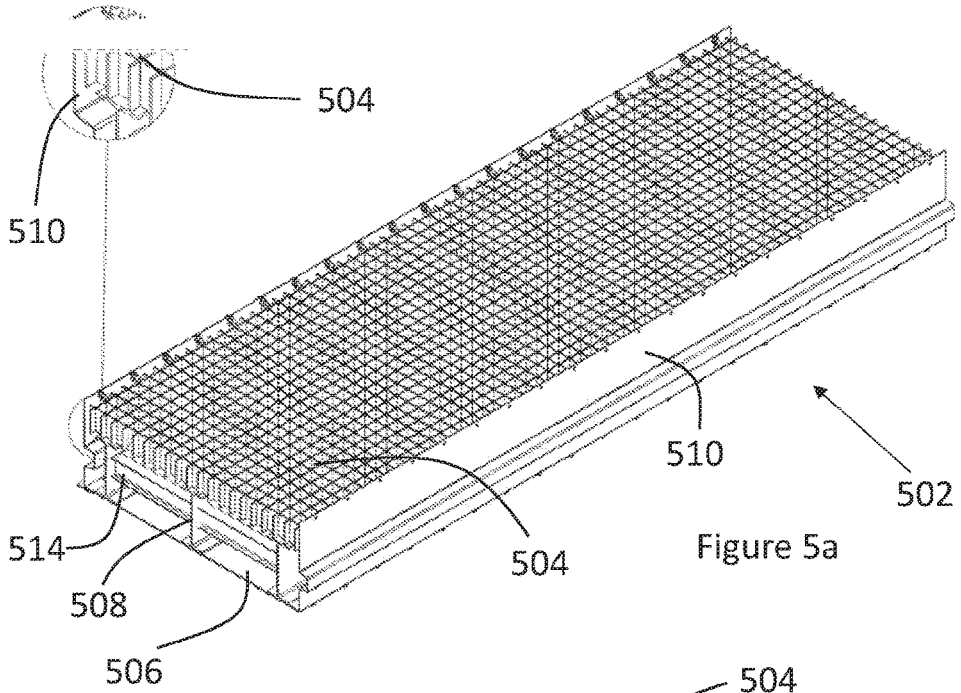
FIG. 5*a* illustrates an isometric view of an absorbing layer in accordance with another exemplary embodiment of the subject matter.
Figure 5B:
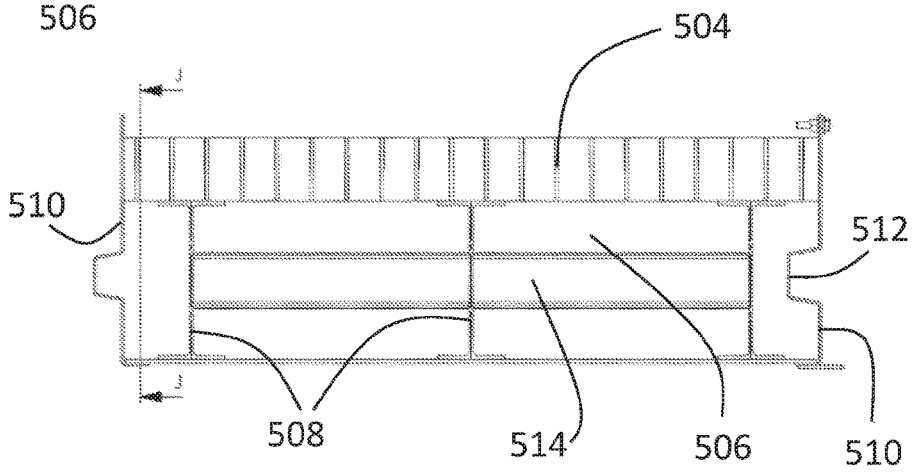
FIG. 5*b* illustrates a frontal view of the segment shown in FIG. 5*a*.
Figure 5C:
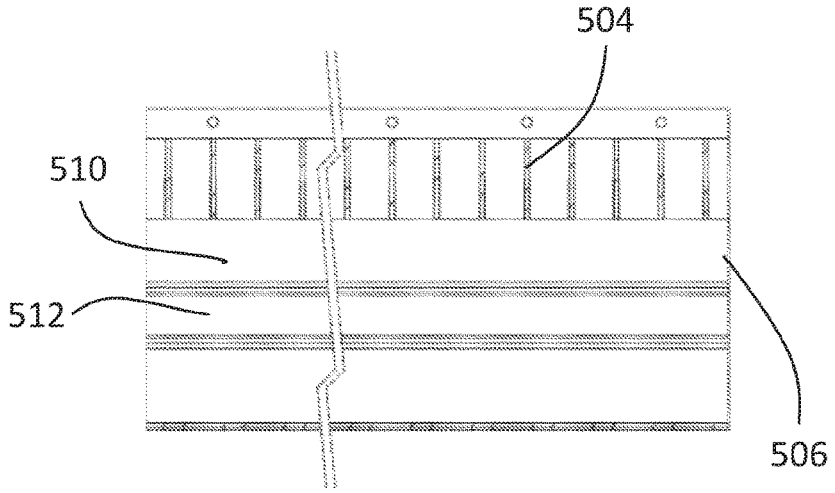
FIG. 5*c* illustrates a side view of the segment shown in FIG. 5*a*.

Reference is now made to FIGS. 5*a*, 5*b*, and 5*c* illustrating a view of a single segment of an absorbing layer in accordance with another exemplary embodiment of the subject matter. The bottom layer is made of several segments, one of which can be seen in FIGS. 5*a*-*c*. The bottom layer 502 comprises of at least two layers—a mesh layer 504 of relatively thin metal and a barrel 506 underneath the mesh layer 504 that is supported by shafts, bars, beams, or other possible supporters as will be explained herein after. The bottom layer 504 is embedded with concrete that spilled within the barrel and the mesh so as to incur additional strength to the layer. Layer 504 (102 in FIG. 1) is capable of absorbing the crushes pieces of the descending element that passed through the upper layer. The concrete is not shown in the figure but can be spilled into the mesh and barrel after the constructions is built.

The mesh layer 504 is mounted on top of the barrel 506, and is supported by beams and bars connected through screws, pins or any other connecting means.

It should be mentioned that spilling concrete so as to embed the metal parts within the concrete when it is being hardened is only one possibility to form the absorbing structure. It is also possible to provide a hard concrete onto which the pieces and sheets of metal will be connected through screws, pins, force connectors, etc.

The concrete can be made of plain concrete, reinforced concrete, composite material, or any other possible material without limiting the scope of the disclosed subject matter. Sand, stones, polyester materials, reinforced particles of composite materials or aggregates from any type can be added to the concrete or the other materials.

Since the barrel layer 506 is acting as an absorbing layer; it supposes to uptake a tremendous pressure, and therefore, it is supported by a plurality of supporting shafts 508 that are in a height that accord the height of the barrel layer 506. Supporting shafts 508 has a profile in the shape of the letter I that is supported from both sides so as to support the relatively heavy mesh layer 504 and be supported by itself. The supporting shafts 508 can clearly be seen in the frontal view of FIG. 5*b*.

Alternatively and additionally, strengthening beams 514 are provided approximately at the middle of barrel layer 502. Beams 514 are connected between the shafts 508 so as to render additional strength to the shafts.

A connecting sheet 510 is provided at the edge of the bottom absorbing layer 502 on both sides. The sheet has a bent 512 so as to provide additional strength to the system. The sheets 510 are connected at the bottom of the barrel to a corresponding part of the shafts 508 and to the structure of the mesh 504 at the upper part of the layers 502. It should be noticed that FIG. 5*c* is a J-J cross sectional view of the structure shown in FIG. 5*b*.

Figure 6A:
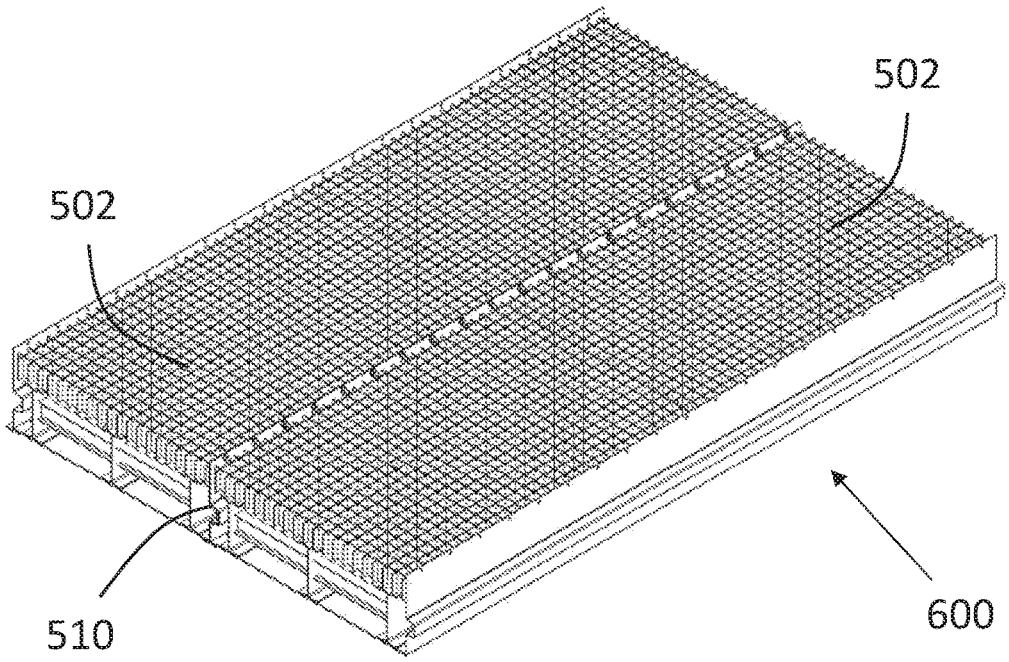
FIG. 6*a* illustrates an isometric view of an absorbing layer made of two single absorbing layers shown in FIG. 5*a*, as an example.
Figure 6B:
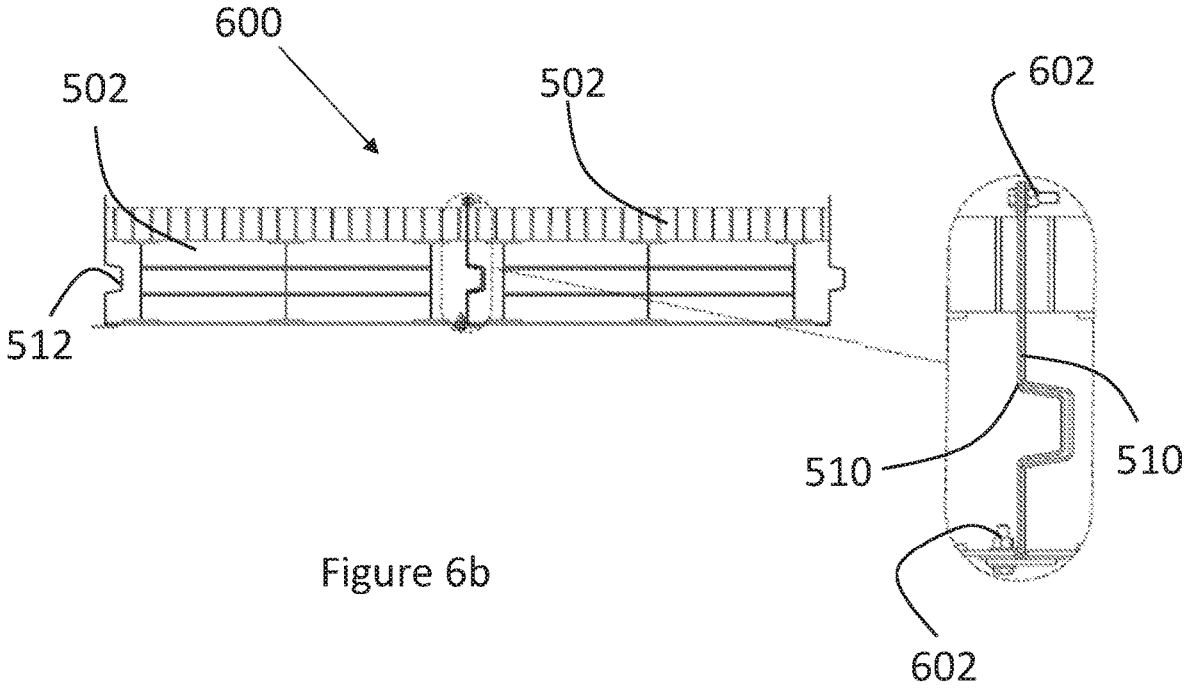
FIG. 6*b* illustrates a frontal view of the layer shown in FIG. 6*a* with better view of the parts.

Reference is now made to FIGS. 6*a-b* illustrating views of two segments of an absorbing layer in accordance with another exemplary embodiment of the subject matter, connected together. Bottom layer 600 comprises two units of connected layers 502. The connection is performed through connecting sheets 510 of two segments that are placed adjacent to each other so as to connect both—this can be clearly seen in FIG. 6*b*, in the enlargement of the connection area. Two connecting sheets 510 from two edges of layers 502 are attached to each other using screws 602 from both sides. It can be seen that the bents 512 from both segments are designed so that one of the bents is accommodated within the other. As mentioned herein before, this renders additional strength to the connected structures. A plurality of units can be connected to each other in this manner so as to establish the bottom layer of the protecting structure in an appropriate size.

It should be mentioned that the poles 106 can be in any length depending on the demands of the structure while it is also possible that the crushing layer, upper layer 102 will be mounted directly onto the absorbing bottom layer 104. It should be also mentioned that the supporting poles 106 can be in different heights so as to provide, as an example, an angle between the upper and the bottom layers while the upper layer 102 will not be parallel to the bottom layer. A predetermined angle can be constructed to a certain direction so that when objects or projectile are expected to descend from a certain angle, the mesh will be directed towards this direction so as to more effectively imply the crushing action of the upper layer that is designed so as to inflict severe damage to the object and crush it.

It is appreciated that certain features of the subject matter, which are, for clarity, described in the context of separate embodiments, may also be provided in combination in a single embodiment. Conversely, various features of the subject matter, which are, for brevity, described in the context of a single embodiment, may also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A protective structure configured to crush descending items into particles, the protective structure comprising:

an upper mesh layer made of hard material capable of crushing the descending items into particles;

a bottom layer made of combined hard material and material that is softer than the hard material, wherein the bottom layer is capable of absorbing the particles; and a plurality of supporting poles that are positioned between said upper mesh layer and said bottom layer, wherein the upper mesh layer is supported on top of the poles.

2. The protective structure as claimed in claim 1, wherein said hard material is metal.

3. The protective structure as claimed in claim 1, wherein said relatively soft material is concrete.

4. The protective structure as claimed in claim 1, wherein said hard material is embedded within said relatively soft material.

5. The protective structure as claimed in claim 1, wherein the material that is softer than the hard material is selected from the group consisting of sand and aggregates.

6. The protective structure as claimed in claim 1, wherein the supporting poles are made of tubes of hard metal filled with concrete.

7. The protective structure as claimed in claim 6, wherein the concrete is reinforced.

8. The protective structure as claimed in claim 1, wherein the supporting poles are made of concrete.

9. The protective structure as claimed in claim 8, wherein the concrete is reinforced.

10. The protective structure as claimed in claim 1, wherein the upper mesh layer is made of a plurality of mesh layers that are in an offset one relative to the other.

11. The protective structure as claimed in claim 1, wherein the upper mesh layer comprises cubicles of substantially 75×75 mm.

12. The protective structure as claimed in claim 1, wherein the upper mesh layer is not horizontal and is directed in a predetermined angle.

13. The protective structure as claimed in claim 1, wherein the bottom layer comprises a bottom mesh layer.

14. The protective structure as claimed in claim 13, wherein the bottom mesh layer is mounted on top of a barrel layer.

15. The protective structure as claimed in claim 14, wherein the bottom mesh layer is supported on top of the barrel layer by supporting shafts.

16. The protective structure as claimed in claim 15, wherein the bottom mesh layer is further supported by beams connected between the supporting shafts.

17. The protective structure as claimed in claim 1, wherein the bottom layer is made of a plurality of adjacent segments, each segment having an edge provided with a connecting sheet, and wherein adjacent segments are connected using the connecting sheets.

18. A protective structure configured to crush descending items into particles, the protective structure comprising:

a rigid upper mesh layer comprised of hard material capable of crushing the descending items into particles; and a bottom layer comprised of combined hard material and relatively soft material that is softer than the hard material, wherein the bottom layer is capable of absorbing the particles; and a plurality of supporting poles that are positioned between said upper mesh layer and said bottom layer, wherein the upper mesh layer is supported on top of the poles, wherein the upper mesh layer comprises a plurality of mesh layers that are in an offset one relative to the other, wherein the bottom layer comprises a bottom mesh layer mounted on top of a barrel layer, and wherein the bottom mesh layer is mounted on top of the barrel layer.

* * * * *